US008142851B2

(12) United States Patent
Tucci et al.

(10) Patent No.: US 8,142,851 B2
(45) Date of Patent: Mar. 27, 2012

(54) METHOD OF FABRICATING A DROP CLOTH USING AN APERTURED SCREEN

(75) Inventors: David Tucci, Alliston (CA); Nick Marascio, Oakville (CA); Ralph De Santo, Bolton (CA)

(73) Assignee: 1778595 Ontario Inc., Ontario (CA)

( * ) Notice: Subject to any disclaimer, the term of this patent is extended or adjusted under 35 U.S.C. 154(b) by 699 days.

(21) Appl. No.: 12/290,067

(22) Filed: Oct. 27, 2008

(65) Prior Publication Data

US 2010/0104821 A1 Apr. 29, 2010

(51) Int. Cl.
*B05D 1/32* (2006.01)

(52) U.S. Cl. ..... 427/282; 427/261; 427/288

(58) Field of Classification Search ..... 427/261, 427/282, 288

See application file for complete search history.

(56) References Cited

U.S. PATENT DOCUMENTS

| | | | | |
|---|---|---|---|---|
| 2,943,380 | A | 7/1960 | Suckle | |
| 4,278,022 | A * | 7/1981 | Fitzpatrick et al. | 101/129 |
| 5,266,390 | A | 11/1993 | Garland | |
| 5,816,305 | A | 10/1998 | May | |
| 6,329,436 | B1 | 12/2001 | Jody et al. | |
| 6,737,114 | B2 * | 5/2004 | Dawson et al. | 427/282 |
| 7,833,619 | B2 | 11/2010 | Frantellizzi | |
| 2007/0275209 | A1 * | 11/2007 | Netravali et al. | 428/99 |
| 2008/0313971 | A1 * | 12/2008 | Frantellizzi | 52/3 |

FOREIGN PATENT DOCUMENTS

WO WO2007/140105 A1 12/2007

OTHER PUBLICATIONS

Edward M. Petrie, Handbook of Adhesives and Sealants 2nd Edition, 2006, pp. 473-477, ISBN 0071479163, 9780071479165, McGraw-Hill Professional, United States, DOI10.1036/0071479163.

Aubuchon Hardware online catalogue on Drop Cloths, http://paint-and-supplies.hardwarestore.com/47-248-drop-cloths.aspx, Retrieved Jun. 27, 2007.

Polsteins Home & Beyond online catalogue showing Kimberly Clark / Scott #77287 4×15 Pro Dropcloth, http://www.homeandbeyond.com/prod-0004518.html, Retrieved Jun. 27, 2007.

Cheap Joe's Art Stuff online catalogue showing Reaves Butyl II Drop Cloth 5'×5', http://www.cheapjoes.com/art-supply/52G48-000EM_10152_reaves-butyl-ii-drop-cloth-x.asp, Retrieved Jun. 27, 2007.

Trimaco website showing protective covers, http://www.trimaco.com/protective_covers.html, Retrieved Jun. 28, 2007.

Home Hardware online catalogue showing Covers & Drop Sheets, http://homehardware.flyerservices.com/netcatalogue/cached_pages/publication.asp, Retrieved Jun. 28, 2007.

* cited by examiner

*Primary Examiner* — Frederick Parker
(74) *Attorney, Agent, or Firm* — Maurice M. Klee

(57) ABSTRACT

A method for fabricating a drop cloth from a sheet of material such as canvas. The sheet of material is formed from a generally liquid impermeable material and has a front surface and a rear surface. The method includes the steps of: depressing an apertured screen onto the front surface of the sheet of material; applying a liquid onto the front surface of the sheet of material through the apertured screen, resulting in the liquid being dispersed in a plurality of spaced apart formations on the front surface of the sheet of material; separating the apertured screen from the sheet of material; and solidifying the liquid to form a plurality of spaced apart solid formations onto the sheet of material.

13 Claims, 4 Drawing Sheets

METHOD OF FABRICATING A DROP CLOTH USING AN APERTURED SCREEN

FIELD

The present invention relates generally to drop cloths used in the construction and painting industry. More particularly, the present invention relates to skid-resistant drop cloths and methods for fabricating the same.

BACKGROUND

It is common in the construction and painting industry to use drop cloths to provide surface protection at a work site. By using drop cloths, a painter can prevent stray paint or other unwanted materials or chemicals from coming into contact with the floors, walls, doors, countertops, furniture, stairs, or any other surface at a work site.

In a typical use, a painter places drop cloths on the floor of a room that is to be painted so that it covers the entire room, and then proceeds to paint the walls of the room while standing on top of the drop cloths. Because the painter stands and works while standing on the drop cloths, the painter may slip when using the drop cloths on a variety of work surfaces, including hardwood floors, vinyl, tile, and marble.

Additionally, some drop cloths must be able to be fabricated cheaply and in large quantities, as a large quantity of drop cloths is required at a typical work site. Because of this economic requirement, a typical drop cloth may be made of a cheap, light and flexible material that is readily available—such as canvas. However, the use of conventional canvas will generally cause the canvas to slide across floors and surrounding furniture. As such, conventional canvas is difficult to use as a drop cloth since a painter standing on a piece of canvas may easily slip and fall.

Some drop cloths are formed by stitching canvas with another rubber-coated fabric together, to prevent slippage. However, the stitching process may be impractical for large-scale processes, and the stitches themselves may be bulky. Further, the stitches may not be guaranteed to be leak-resistant or leak-proof.

It would be advantageous to provide methods and systems for fabricating drop cloths which address at least some of the above-noted difficulties.

SUMMARY

The present application generally provides a skid-resistant drop cloth for use in the construction or painting industry to protect work site surfaces. In one aspect, there is provided a drop cloth which includes a sheet of clothed material being formed from a generally liquid impermeable material, the sheet of material having a front surface and a rear surface, and a plurality of solid spaced apart solid formations being solidified onto the front surface of the sheet of material.

In another aspect, the present application provides a method for fabricating a drop cloth from a sheet of material, the sheet of material being formed from a generally liquid impermeable material and having a front surface and a rear surface. The method includes the steps of: depressing an apertured screen onto the front surface of the sheet of material; applying a liquid onto the front surface of the sheet of material through the apertured screen, resulting in the liquid being dispersed in a plurality of spaced apart liquid formations on the front surface of the sheet of material; separating the apertured screen from the sheet of material; and solidifying the liquid to form a plurality of spaced apart solid formations onto the sheet of material.

DESCRIPTION OF THE FIGURES

Embodiments will now be described by way of example with reference to the accompanying drawings, in which like reference numerals are used to indicate similar features, and in which.

DETAILED DESCRIPTION

In one example embodiment, there is provided a drop cloth which includes a sheet of material being formed from a generally liquid impermeable material, the sheet of material having a front surface and a rear surface, and a plurality of solid spaced apart solid formations being solidified onto the front surface of the sheet of material.

In another example embodiment, there is provided a method for fabricating a drop cloth from a sheet of material, the sheet of material being formed from a generally liquid impermeable material and having a front surface and a rear surface. The method includes the steps of: depressing an apertured screen onto the front surface of the sheet of material; applying a liquid onto the front surface of the sheet of material through the apertured screen, resulting in the liquid being dispersed in a plurality of spaced apart liquid formations on the front surface of the sheet of material; separating the apertured screen from the sheet of material; and solidifying the liquid to form a plurality of spaced apart solid formations onto the sheet of material.

Figure 2:
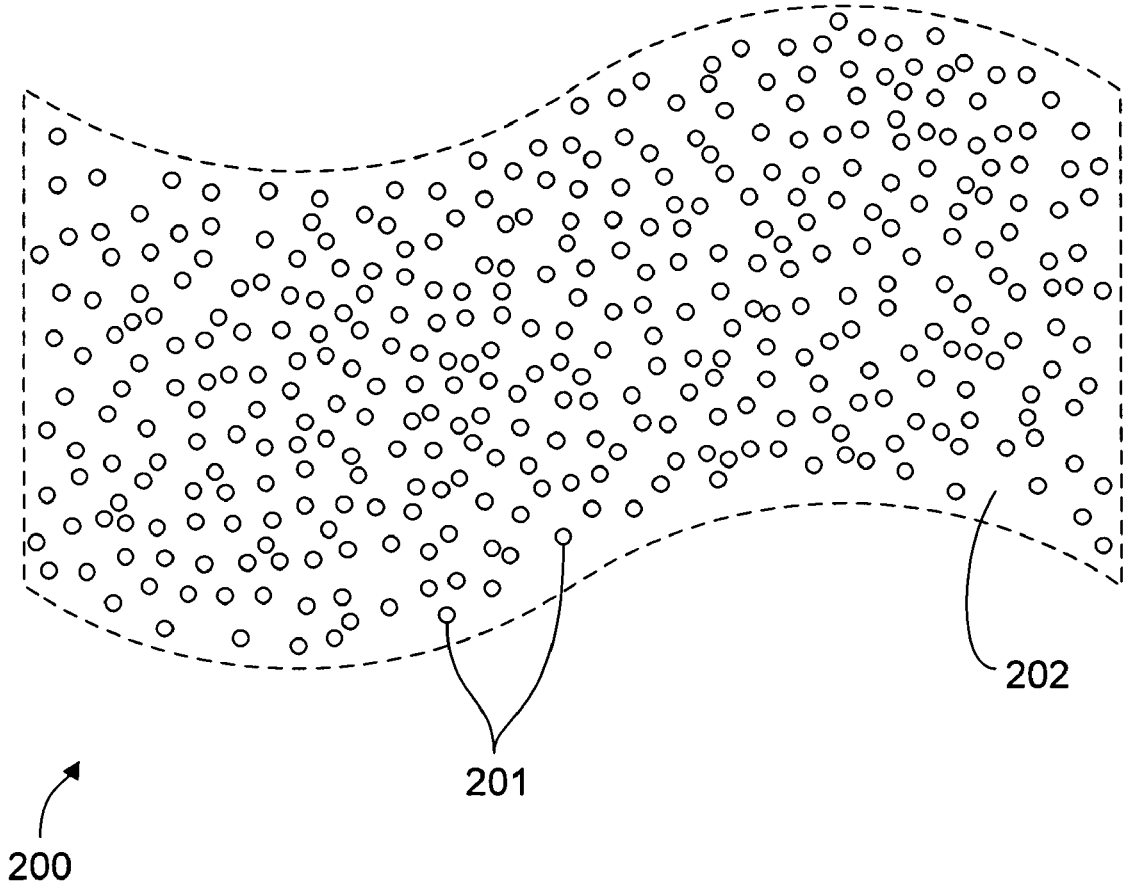
FIG. 2 is a bottom view of an embodiment of a drop cloth.

Reference is now made to FIG. 2, which shows a bottom view of a drop cloth 200 in accordance with an example embodiment. The drop cloth 200 may extend beyond the area as shown and may in fact be of any desired length or width.

Figure 3:
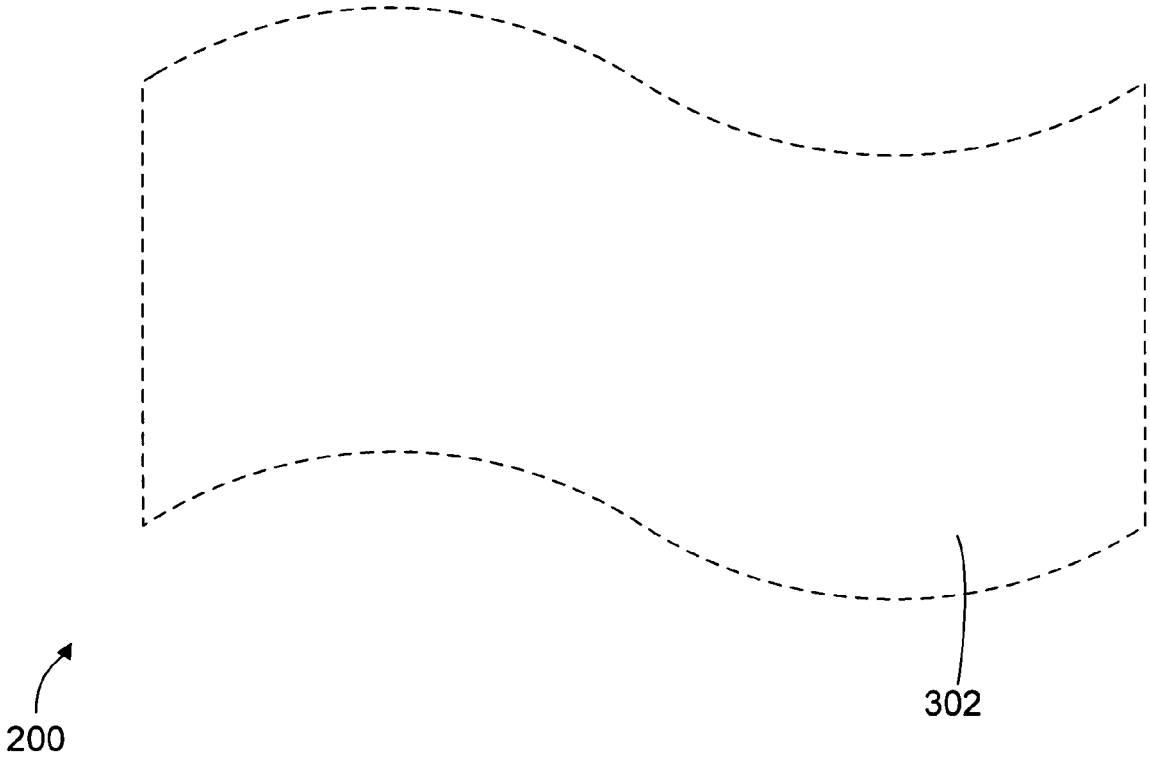
FIG. 3 is a top view of the drop cloth of FIG. 2.

As shown in FIG. 2 and FIG. 3, the drop cloth 200 has two opposing surfaces, being a front drop cloth surface 202 and a rear drop cloth surface 302. In FIG. 2, a front drop cloth surface 202 and a plurality of spaced apart solid formations 201 are shown. The plurality of spaced apart solid formations 201 are solidified onto the front drop cloth surface 202, as is described in greater detail below. In use, the drop cloth 200 is placed so that the front drop cloth surface 202 and the spaced apart solid formations 201 are in contact with the floor or surface of the work site that is to be protected, and the rear drop cloth surface 302 faces away from the floor or surface of the work site that is to be protected.

Front drop cloth surface 202 and rear drop cloth surface 302 may be made of any sheet of flexible material, including material that absorbs liquids, material impervious to liquids, materials that are generally liquid impermeable or semi-impermeable, or any combinations thereof. Non-limiting examples may include woven fabrics such as canvas.

While front drop cloth surface 202 and rear drop cloth surface 302 are shown as a single layer. In some other example embodiments, drop cloth 200 may be made of multiple layers bonded together, and as such front drop cloth surface 202 and rear drop cloth surface 302 may not be opposite sides of the exact same piece of material.

The plurality of spaced apart solid formations 201 are generally formed of a material that has a relatively higher coefficient of friction than conventional canvas with respect to a variety of household surfaces. The plurality of spaced apart solid formations 201 may form a plurality of raised surfaces with respect to the front drop cloth surface 202. The plurality of spaced apart solid formations 201 may be relatively flexible and attachable to front drop cloth surface 202. In some example embodiments, the plurality of spaced apart solid formations 201 are formed from liquid polyvinyl chloride (PVC) and the drop cloth 200 is made of canvas. In FIG. 2, the plurality of spaced apart solid formations 201 are not illustrated to scale with respect to the drop cloth 200 and may be much smaller than as illustrated.

The plurality of spaced apart solid formations 201 may be dimensioned to provide a minimum aggregate surface area presented to the work site surface, in relation to a working surface area of the drop cloth 200 in order to provide the desired skid-resistance. For example, if the plurality of spaced apart solid formations 201 are placed too far apart, it may present insufficient aggregate surface area to the floor or work site surface and skid-resistance would be compromised. It can also be appreciated by those skilled in the art that there may be a maximum limit on the individual size of each raised surface 201 in order to ensure that the drop cloth 200 remains flexible. For example, if the cloth 200 has plurality of spaced apart solid formations 201 that are too big, too wide or too thick, the drop cloth 200 may become rigid and fail to follow the various contours of a work site surface—creating tripping or other safety hazards.

Therefore, while the spatial frequency, size, and shape of the plurality of spaced apart solid formations 201 may vary across different embodiments, a minimum and a maximum aggregate spaced apart solid formations 201 to drop cloth surface ratio may be calculated. This ratio, for brevity called the formation-surface ratio, is defined as the ratio between the aggregate surface area of the plurality of spaced apart solid formations 201 to the total working surface area of the drop cloth 200. In some example embodiments, the minimum aggregate surface area of the plurality of spaced apart solid formations 201 is at least ⅓ or 33% of the total surface area of the drop cloth 200, and the maximum aggregate surface area of the plurality of spaced apart solid formations 201 is at most ¾ or 75% of the total surface area of the drop cloth 200.

It can be appreciated by those skilled in the art that plurality of spaced apart solid formations 201 may be of any size or shape, as long as the above minimum and maximum formation-surface ratios are met. For example, the plurality of spaced apart solid formations 201 may be star-shaped, moon-shaped or any other shape. Such changes would be understood by those skilled in the art to be largely for aesthetic purposes; as long as the above formation-surface ratios are met for the drop cloth 200 to provide skid-resistance. In some example embodiments, the plurality of spaced apart solid formations 201 is distributed as evenly as possible across the front drop cloth surface 202.

It can be appreciated by those skilled in the art that the plurality of spaced apart solid formations 201 are relatively thin in order to retain flexibility and prevent the occurrence of large bumps. In one embodiment, the thickness of the plurality of spaced apart solid formations 201 is relatively thin, on the scale of 1 millimeter.

Figure 1:
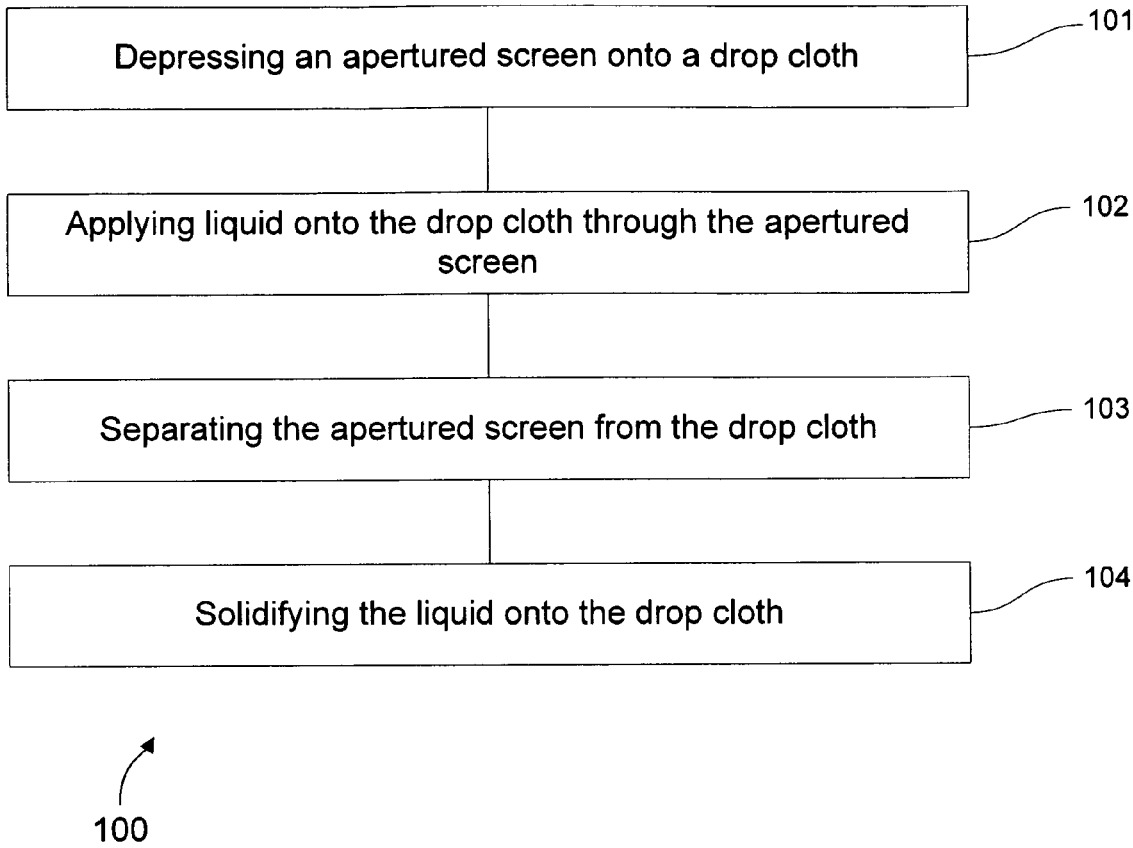
FIG. 1 is a flowchart illustrating a fabrication process of a drop cloth in accordance with a present embodiment.
Figure 4:
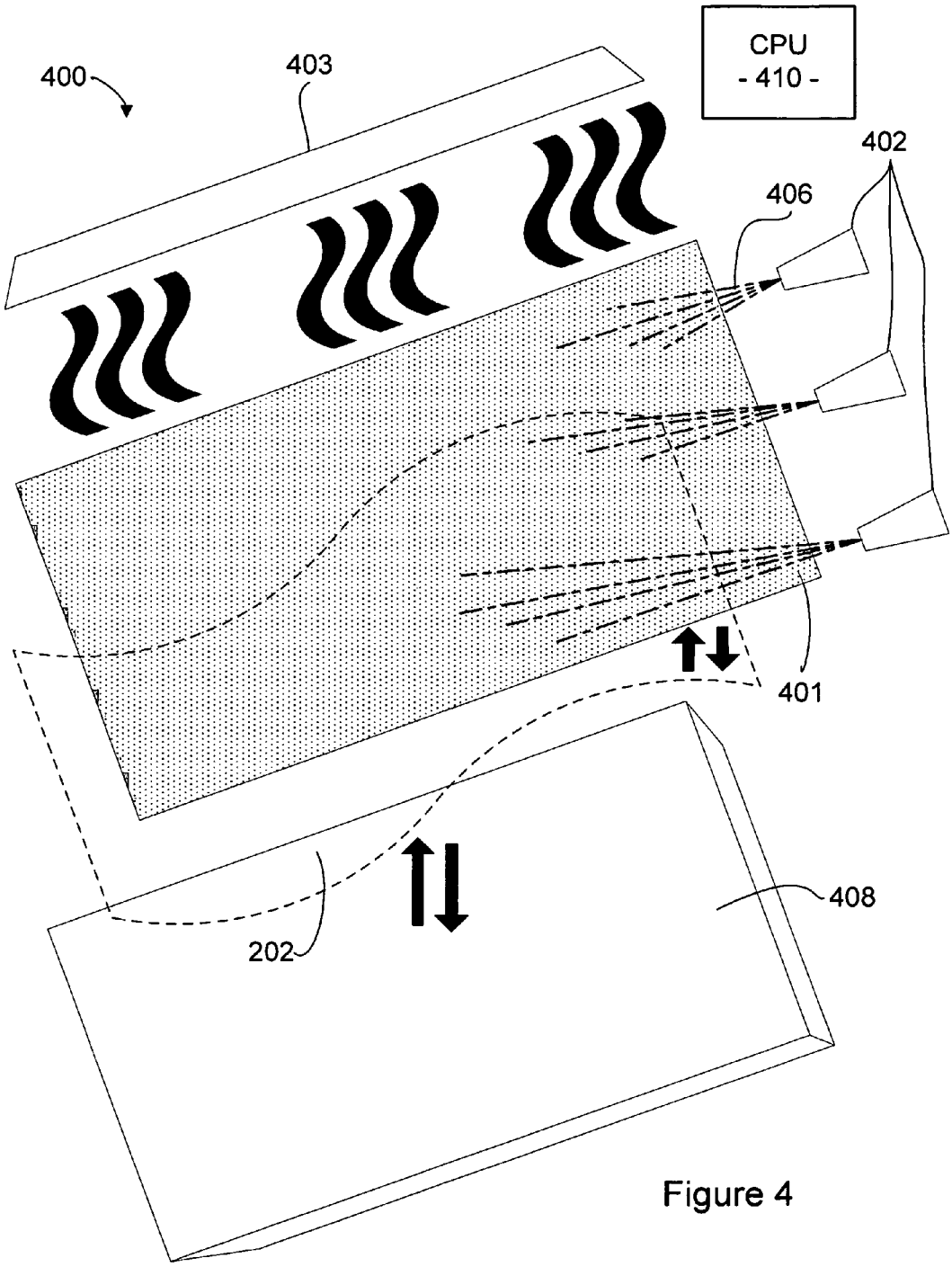
FIG. 4 is a perspective view of a system for fabricating the drop cloth of FIG. 2 in accordance with an example embodiment.

Reference is now made to FIG. 1, which shows a flowchart of a method 100 to fabricate the drop cloth 200 in accordance with an example embodiment. Reference is also made to FIG. 4, which shows a perspective view of a system 400 which may be used to implement the method of FIG. 1.

The system 400 may generally be controlled by a (central processing unit) CPU 410 which may implemented by a suitably configured computer system. At step 101, an apertured screen 401 is depressed onto the front drop cloth surface 202. As shown in FIG. 4, the drop cloth 200 is laid on a platform 408 with the front drop cloth surface 202 exposed, and the apertured screen 401 is lowered onto it. At step 102, after the apertured screen 401 is depressed onto front drop cloth surface 202, a liquid 406 is applied onto the drop cloth 200 through the apertures in the apertured screen 401. In one embodiment, the liquid 406 is formed of plasticized PVC, such as plastisol. In the embodiment shown in FIG. 4, liquid PVC is sprayed by spraying devices 402 onto the front drop cloth surface 202 through the apertures in the apertured screen 401. At step 103, the apertured screen 401 is then separated from the front drop cloth surface 202, for example the apertured screen 401 is raised from the drop cloth 200, as in FIG. 4. At step 103, the apertured screen 401 is then separated, i.e. raised as shown, from the front drop cloth surface 202. At step 104, the liquid 106 is solidified onto the front drop cloth surface 202, resulting in the plurality of spaced apart solid formations 201. In some example embodiments, when the liquid 206 is formed from liquid PVC, the liquid PVC polymerizes (which may also be referred to as "solvates", or "curing") by raising the temperature to 240 degrees Celsius. This temperature remains for a period of 5 seconds to effect the polymerization of the liquid PVC. The drop cloth 200 may then be left at room temperature which cools the PVC and may further solidify the plurality of spaced apart solid formations 201. A suitable temperature and duration of heat may be controlled by the CPU 410 and selected depending on the particular solvent and the particular application.

Referring now to step 102, depending on the material selected as the liquid 406, the choice of application method may vary. In another example embodiment, liquid PVC is painted onto front drop cloth surface 202 via painting devices (not shown) through the apertures in the apertured screen 401.

The apertured screen 401 acts as a mask, determining the spatial frequency, size and shape of the plurality of spaced apart solid formations 201. It can be appreciated by those skilled in the art that the apertures in the apertured screen 401 may be varied with respect to spatial frequency, size, and shape with no detrimental effects on skid-resistance and flexibility as long as the range of formation-surface ratios as discussed above are met. It can be appreciated by those skilled in the art that the plurality of spaced apart solid formations 201 may be distributed as evenly as possible across the front drop cloth surface 202.

In some example embodiments, liquid PVC provides a relatively inexpensive material to attach to the drop cloth 200 and would not be easily detachable from the drop cloth 200. PVC may also provide the flexibility (with the addition of appropriate plasticizers) to provide for some flexibility for use with the drop cloth 200. PVC also typically provides a higher coefficient of friction than canvas. Other materials other than PVC may also be selected, for example various rubberized polymers.

It can be appreciated that the above process would be suitable for larger sheets of materials. Further, the larger sheets or material may be subsequently sheared or cut by a cutting tool (not shown). As an example, the drop cloth 200 may be cut to a generally rectangular dimension of at least 4 feet by 10 feet, depending on the particular application required.

It can also be appreciated by those skilled in the art that any of the methods described above may be used repeatedly and in a large scale in order to produce large quantities of the drop cloth or drop cloths.

While the invention has been described in detail in the foregoing specification, it will be understood by those skilled in the art that variations may be made without departing from the scope of the invention.

What is claimed is:

1. A method for fabricating a drop cloth from a sheet of material, the sheet of material being formed from a generally liquid impermeable material and having a front surface and a rear surface, the method comprising the steps of:

depressing an apertured screen onto the front surface of the sheet of material;

applying a liquid onto the front surface of the sheet of material through the apertured screen, resulting in the liquid being dispersed in a plurality of spaced apart liquid formations on the front surface of the sheet of material;

separating the apertured screen from the sheet of material; and solidifying the liquid to form a plurality of spaced apart solid formations onto the sheet of material;

wherein the liquid is applied onto the sheet of material through the apertured screen by a spraying device.

2. The method of claim 1 wherein the liquid is formed of polyvinyl chloride.

3. The method of claim 1 wherein the liquid is formed of plastisol.

4. The method of claim 1, wherein the liquid is a plasticized polymer and wherein the step of solidifying the liquid includes raising the temperature of the liquid to at least above a polymerization temperature of the liquid.

5. The method of claim 1 wherein the plurality of spaced apart solid formations has a coefficient of friction higher than the sheet of material.

6. The method of claim 1, further comprising repeating the method on another sheet of material.

7. The method of claim 1, wherein the sheet of material is dimensioned to be generally rectangular.

8. The method of claim 1, wherein the sheet of material is dimensioned to be at least 10 feet by 4 feet.

9. The method of claim 1, further comprising the step of cutting the sheet of material into smaller sheets of material.

10. The method of claim 1, wherein the plurality of spaced apart solid formations form a plurality of raised surfaces on the sheet of material.

11. The method of claim 1, wherein the sheet of material is a single-layer clothed material.

12. The method of claim 1, wherein the sheet of material is formed of canvas.

13. The method of claim 1, wherein the sheet of material is formed of a woven fabric.

* * * * *